US006796304B2

(12) United States Patent
Odell et al.

(10) Patent No.: US 6,796,304 B2
(45) Date of Patent: Sep. 28, 2004

(54) PERSONAL CONTAINMENT SYSTEM WITH SEALED PASSTHROUGH

(75) Inventors: Raymond Odell, Hertfordshire (GB); Martin J. Avery, Middlesex (GB); Jason A. Graves, Berkshire (GB)

(73) Assignee: 3M Innovative Properties Company, St. Paul, MN (US)

( * ) Notice: Subject to any disclaimer, the term of this patent is extended or adjusted under 35 U.S.C. 154(b) by 5 days.

(21) Appl. No.: 10/263,894

(22) Filed: Oct. 3, 2002

(65) Prior Publication Data

US 2003/0192537 A1 Oct. 16, 2003

Related U.S. Application Data

(63) Continuation-in-part of application No. 10/121,306, filed on Apr. 12, 2002, now abandoned.

(51) Int. Cl.[7] ..... A62B 17/00

(52) U.S. Cl. ..... 128/201.29; 128/204.18; 128/205.12; 128/205.26; 128/205.27

(58) Field of Search ..... 48/207, 475.1–500.1; 251/359–365, 900; 128/200.24, 201.19, 201.22–202.12, 202.19, 202.73, 202.27, 204.18, 205.18, 205.22, 205.27–206.19, 207.14, 207.18

(56) References Cited

U.S. PATENT DOCUMENTS

| | | | |
|---|---|---|---|
| 3,064,488 A | 11/1962 | Lee et al. | |
| 3,446,420 A | 5/1969 | Rinecker | |
| 3,525,334 A | 8/1970 | Braman et al. | |
| 3,768,467 A | 10/1973 | Jennings | |
| 3,777,750 A | 12/1973 | Savornin | |
| 4,172,454 A | 10/1979 | Warncke et al. | |

(List continued on next page.)

FOREIGN PATENT DOCUMENTS

| | | | |
|---|---|---|---|
| DE | 156463 | 9/1982 | |
| DE | 93 04 883 U1 | 6/1993 | |
| EP | 0 233 995 A1 | 9/1987 | |
| EP | 0 211 914 B1 | 10/1988 | |
| EP | 0 464 234 A1 * | 7/1990 | ..... 128/204.18 |
| EP | 0 468 188 B1 | 1/1992 | |
| EP | 0 474 372 A2 | 3/1992 | |
| EP | 0 353 417 B1 | 11/1992 | |
| EP | 0 488 880 B1 | 10/1995 | |
| FR | 2 565 662 | 12/1985 | |
| GB | 2 032 255 A | 5/1980 | |
| GB | 2061696 A | 5/1981 | |

(List continued on next page.)

OTHER PUBLICATIONS

"The Next Step . . ." 3M Innovation Brochure (2001).

"SE–Shield Protective Suit for SE400", downloaded from the internet archive site at http://web.archive.org/web/*/http://www.sea.com.au/docs/data/dsseshield.htm . According to the internet archive, this page first appeared on Jan. 11, 2002.

*Primary Examiner*—Glenn K. Dawson
(74) *Attorney, Agent, or Firm*—Karl G. Hausen; David R. Cleveland

(57) ABSTRACT

A personal containment system includes a generally fluid-tight barrier and a powered air delivery system. The blower is generally isolated from the outer environment and draws purified air from a filter in fluid communication with the blower and generally located outside the containment system. A sealed port between the blower and filter provides a generally fluid tight connection to the barrier and blower during filter replacement. Leakage of contaminants into the system is minimized, and limited to materials that might enter the blower inlet. The blower inlet remains accessible during filter replacement, thereby speeding and simplifying the filter replacement process.

15 Claims, 5 Drawing Sheets

U.S. PATENT DOCUMENTS

| | | | | | |
|---|---|---|---|---|---|
| 4,272,851 | A | | 6/1981 | Goldstein | |
| 4,458,680 | A | | 7/1984 | Childers et al. | |
| 4,602,658 | A | | 7/1986 | Luther et al. | |
| 4,614,186 | A | | 9/1986 | John | |
| 4,651,727 | A | | 3/1987 | Howorth | |
| 4,741,333 | A | | 5/1988 | Suzuki et al. | |
| 4,771,771 | A | | 9/1988 | Walther | |
| 4,807,614 | A | | 2/1989 | van der Smissen et al. | |
| 4,811,728 | A | | 3/1989 | Von Kopp | |
| 4,818,122 | A | | 4/1989 | Arbuthnot | |
| 4,864,654 | A | | 9/1989 | Schriver et al. | |
| 4,881,539 | A | | 11/1989 | Pasternack | |
| 4,899,740 | A | | 2/1990 | Napolitano | |
| 4,903,694 | A | | 2/1990 | Hager | |
| H863 | H | | 1/1991 | Kwiedorowicz et al. | |
| 5,003,974 | A | | 4/1991 | Mou | |
| 5,125,402 | A | | 6/1992 | Greenough | |
| 5,140,980 | A | | 8/1992 | Haughey et al. | |
| 5,186,165 | A | | 2/1993 | Swann | |
| 5,233,975 | A | * | 8/1993 | Choate | 128/200.14 |
| 5,265,592 | A | * | 11/1993 | Beaussant | 128/201.24 |
| 5,309,901 | A | | 5/1994 | Beaussant | |
| H1316 | H | | 6/1994 | McGuinness | |
| 5,339,806 | A | | 8/1994 | Beaussant et al. | |
| H1360 | H | | 10/1994 | Grove et al. | |
| 5,431,156 | A | | 7/1995 | Sundstrom | |
| 5,515,846 | A | | 5/1996 | Drews | |
| 5,526,804 | A | | 6/1996 | Ottestad | |
| 5,653,225 | A | | 8/1997 | Schegerin | |
| 5,690,095 | A | | 11/1997 | Glynn et al. | |
| 5,752,282 | A | * | 5/1998 | Silveri | 4/541.1 |
| 5,832,919 | A | | 11/1998 | Kano et al. | |
| 5,921,388 | A | | 7/1999 | Petrilli et al. | |
| 5,957,131 | A | | 9/1999 | Hutchinson et al. | |
| 5,975,081 | A | * | 11/1999 | Hood et al. | 128/845 |
| 6,014,971 | A | | 1/2000 | Danisch et al. | |
| 6,076,571 | A | | 6/2000 | Burns et al. | |
| 6,158,429 | A | | 12/2000 | Gardner et al. | |
| 6,245,009 | B1 | * | 6/2001 | Travis et al. | 600/20 |
| 6,296,693 | B1 | * | 10/2001 | McCarthy | 96/117.5 |
| 6,340,024 | B1 | * | 1/2002 | Brookman et al. | 128/201.25 |
| 6,508,850 | B1 | * | 1/2003 | Kotliar | 55/385.2 |
| 6,575,165 | B1 | | 6/2003 | Cook et al. | |
| 2001/0052144 | A1 | | 12/2001 | Paris et al. | |
| 2003/0024529 | A1 | * | 2/2003 | Beizndtsson et al. | 128/201.29 |
| 2003/0192537 | A1 | * | 10/2003 | Odell et al. | 128/201.22 |
| 2003/0192541 | A1 | * | 10/2003 | Avery et al. | 128/204.18 |

FOREIGN PATENT DOCUMENTS

| | | | |
|---|---|---|---|
| GB | 2173705 | A | 10/1986 |
| GB | 2 220 573 | A | 1/1990 |
| GB | 2 247 175 | | 2/1992 |
| GB | 2 247 396 | A | 3/1992 |
| WO | WO 86 04508 | | 8/1986 |
| WO | WO 92/04835 | | 4/1992 |
| WO | WO 92/09332 | | 6/1992 |
| WO | WO 92/18201 | | 10/1992 |
| WO | WO 01 41873 | | 6/2001 |
| WO | WO 01/74449 | A1 | 10/2001 |
| WO | WO 02/11815 | | 2/2002 |

* cited by examiner

PERSONAL CONTAINMENT SYSTEM WITH SEALED PASSTHROUGH

CROSS-REFERENCE TO RELATED APPLICATION

This application is a continuation-in-part of application Ser. No. 10/121,306 filed Apr. 12, 2002, entitled PERSONAL CONTAINMENT SYSTEM WITH ISOLATED BLOWER, now abandoned, the entire disclosure of which is incorporated herein by reference.

This invention relates to personal containment systems such as protective suits and protective tents adapted to isolate a wearer or user from a contaminated environment. This invention also relates to personal containment systems having a filtered air delivery system.

BACKGROUND

Personal containment systems can protect a user from a variety of harmful chemical or biological agents. Many examples of personal containment systems that can surround a user are known, such as protective suits, protective tents, casualty bags for injured persons, and the like. These systems preferably isolate the user's entire body from contaminants. Often, the contaminants include respiratory hazards, and the systems must employ air delivery systems so that the user is able to breathe when isolated from the environment. Respirators are often used in conjunction with personal protection systems to provide the user with purified air. A variety of respirators are known and described below.

Certain personal containment systems employ a non-powered purifying respirator. Air is drawn into the system through a filter by the user's breathing action. When the user draws a breath, negative pressure is created in the system and air is drawn in through the filter. When the user expels a breath, spent air leaves the system through a valve.

A powered air-purifying respirator (PAPR) can be employed to supply a continuous stream of filtered air under positive pressure to a personal containment system. A typical PAPR includes a filter attached to a blower which delivers filtered air to the system. Such air delivery can involve a conduit that ducts air to a hood or a spigot on a protective garment. PAPRs are generally powered by a battery. When used with a protective garment, the PAPR blower typically is mounted on a belt wrapped around a user's waist or on a harness strapped to the user's torso, and worn externally. PAPRs are generally employed in industrial applications where the environmental hazards are well defined and quantified.

A self-contained breathing apparatus (SCBA) is another variety of respirator employed as a part of a personal containment system. A SCBA typically supplies air or oxygen from a portable source to a regulator or other breathing device worn by the user. A SCBA worn inside a sealed protective suit provides the user with a fully contained protective environment. SCBA systems employed in this manner can be used when the nature of the hazard is not known, or in environments that might be void of oxygen.

SUMMARY OF THE INVENTION

Recently published PCT Application No. WO 01/74449 A1 describes a protective suit having a harness-borne pump unit positioned inside the suit. A port is provided for air to be drawn in from outside the protective suit. A filter may be positioned outside the suit and screwed to a spigot extending from the pump unit through the port. An air-tight connection is said to be made around the port when the filter and pump are properly connected so that no air may pass through the port without passing through the filter.

If the filter in such a device is misconnected or disconnected, leakage could occur between the port and spigot. In addition, sudden movement by the user or other disturbance of the suit while the filter is disconnected might cause the spigot to withdraw from the port and dangle inside the suit. That could make it much more difficult to replace the filter quickly, especially if filter replacement is attempted while in a hazardous environment.

The invention provides, in one aspect, a personal containment system comprising:

a generally fluid-tight barrier having an inner surface defining an inner environment that can surround a user of the containment system and an outer surface defining an outer environment that can contain one or more hazards;

an air delivery system that can provide filtered air from the outer environment to the inner environment, comprising a replaceable filter exposed to the outer environment and a blower generally isolated from the outer environment and in fluid communication with the filter; and a port for delivery of filtered air through the barrier to the blower, the port providing a generally fluid tight connection to the barrier and blower during filter replacement.

The invention may permit replacement of the filter under hazardous conditions, without requiring the user to exit a contaminated or otherwise hazardous environment. Leakage of contaminants into the system is minimized, and limited to materials that might enter the blower inlet. The blower inlet remains accessible during filter replacement, thereby speeding and simplifying the filter replacement process.

DETAILED DESCRIPTION

Figure 1:
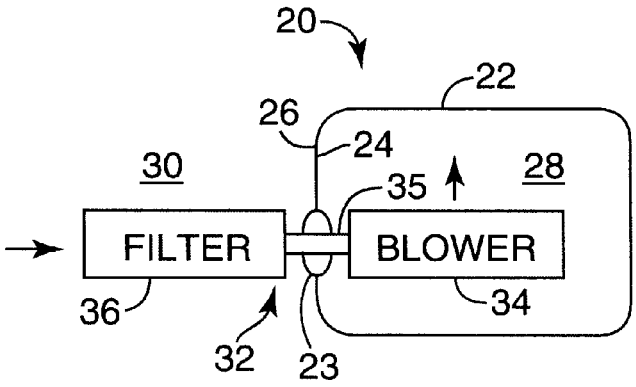
FIG. 1 shows a schematic view of a personal containment system constructed in accordance with the present invention.

FIG. 1 shows a schematic view of an example, or embodiment, of personal containment system 20 constructed in accordance with the present disclosure. The personal containment system 20 includes a generally fluid-tight barrier 22 having an inner surface 24 and an outer surface 26. The generally fluid tight barrier 22 is adapted to define an inner environment 28 interfacing with inner surface 24, and an outer environment 30 interfacing with outer surface 26. System 20 also includes an air delivery system 32 powered by a blower 34. Blower 34 is generally isolated from outer environment 30 and draws filtered air through filter 36. Filter 36 is exposed to outer environment 30. Filter 36 and blower 34 are in fluid communication through conduit 35. Sealed port 23 provides a generally fluid-tight connection to barrier 22 and blower 34 during removal and replacement of filter 34. Sealed port 23 preferably is sufficiently fixed in position or otherwise located with respect to blower 34 so that the location of the inlet to blower 34 remains accessible during filter removal and replacement despite movement or other disturbance of the containment system 20 while the filter 36 is disconnected.

The personal containment system 20 can be any of a variety of protection systems that surround or otherwise encase or encapsulate the user and may be suitable for protecting living things from a contaminated or hazardous environment. For example, the personal containment system can be a protective garment such as a chemical suit. Other examples include a tent or a casualty bag. Still other examples, both known and unknown, are intended to fall within the scope of this invention. The personal containment system defines an inner environment 28. Inner environment 28 is intended to be habitable and contaminant-free when worn in a contaminated or hazardous outer environment 30.

Figure 2:
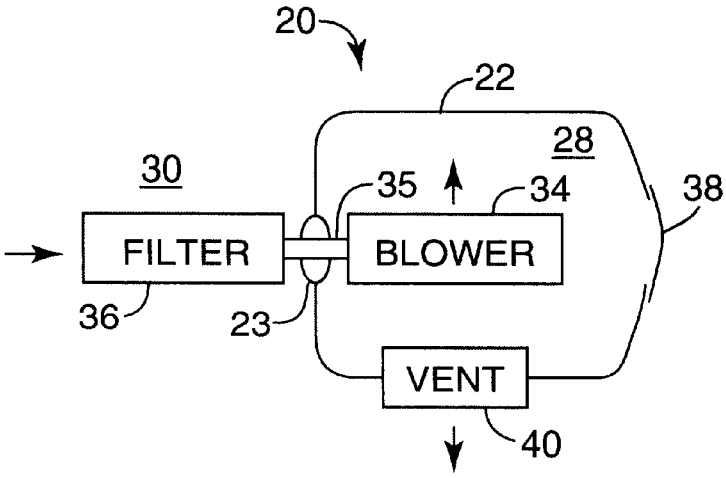
FIG. 2 through FIG. 6 show schematic views of various examples of personal containment systems of FIG. 1.

FIG. 2 through FIG. 5 show alternative embodiments of the general personal containment system 20 of FIG. 1, where like parts have like reference numerals. FIG. 2 is a schematic view of personal containment system 20 including an attachment 38. Attachment 38 can be one or more pieces suitably sealably joined to the remainder of personal containment system 20. Accordingly, FIG. 2 can be a schematic representation of a suit with attached gloves, boots and hood, or the like. FIG. 2 also includes a vent 40 to permit gasses to escape. In one embodiment, vent 40 is a one-way valve that opens automatically after the pressure within inner environment 28 has reached a certain threshold. More than one vent 40 can be used. Vent 40 can be attached to barrier 22, attachment 38, or both. In another embodiment, the vent is an exhaust filter.

Figure 3:
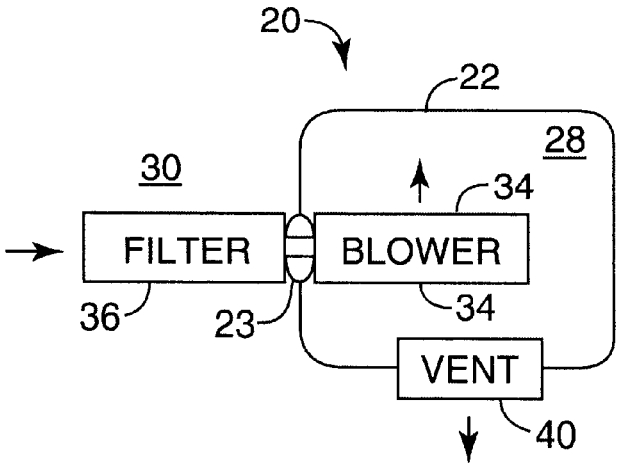

FIG. 3 is a schematic representation of a personal containment system 20 in which blower 34 and filter 36 both contact sealed port 23. When filter 35 is removed, port 23 remains sealably attached to and preferably is fastened or otherwise affixed to blower 34.

Figure 4:
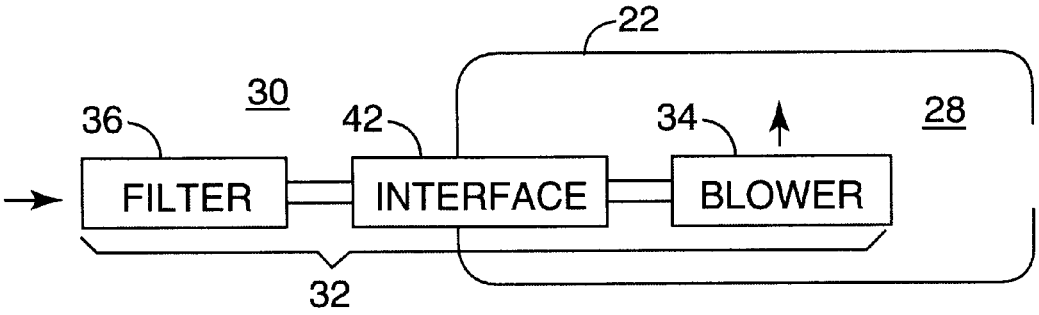
Figure 5:
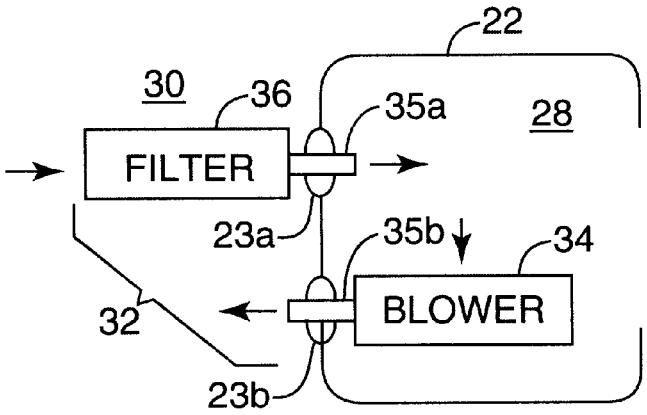

FIG. 4 and FIG. 5 show schematic examples of other ways air delivery system 32 can be connected through barrier 22. In FIG. 4, filter 36 is connected to blower 34 via a mounting interface 42, with interface 42 being sealably and preferably fixedly connected to both filter 36 and blower 34. One example of an interface 42 is described below in relation to FIG. 9. In FIG. 5, filter 36 is in fluid communication with inner environment 28 via a first conduit 35*a* sealably connected to a first port 23*a*. Blower 34 is in fluid communication with outer environment 30 via a second conduit 35*b* sealably connected to a second port 23*b*. Air from outer environment 30 is drawn into filter 36, passes into inner environment 28, and then is exhausted to outer environment 30 by blower 34.

Figure 6:
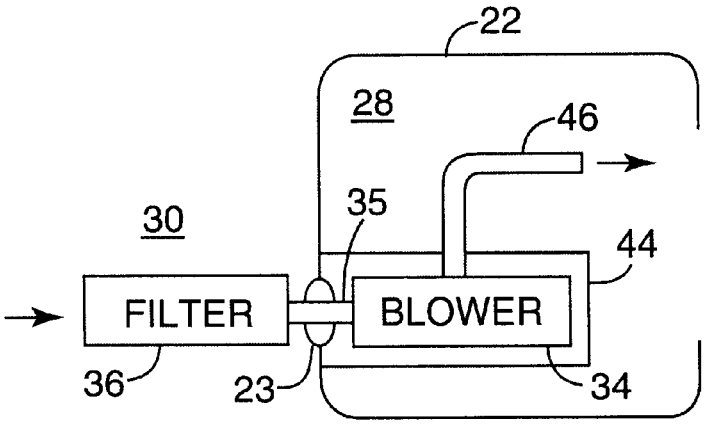

Air delivery system 32 can also include a further conduit, indicated in FIG. 6 at 46, that delivers air into a region (e.g., a hood or face piece) within inner environment 28. FIG. 6 also shows blower 34 isolated from outer environment 30 and not disposed within inner environment 28. Rather, blower 34 is sectioned off by partition 44 from inner environment 28. Blower 34 need not be hermetically sealed from both the inner and outer environments, and may be supported in a pouch or pocket on the inner surface 24 of barrier 22.

Figure 7:
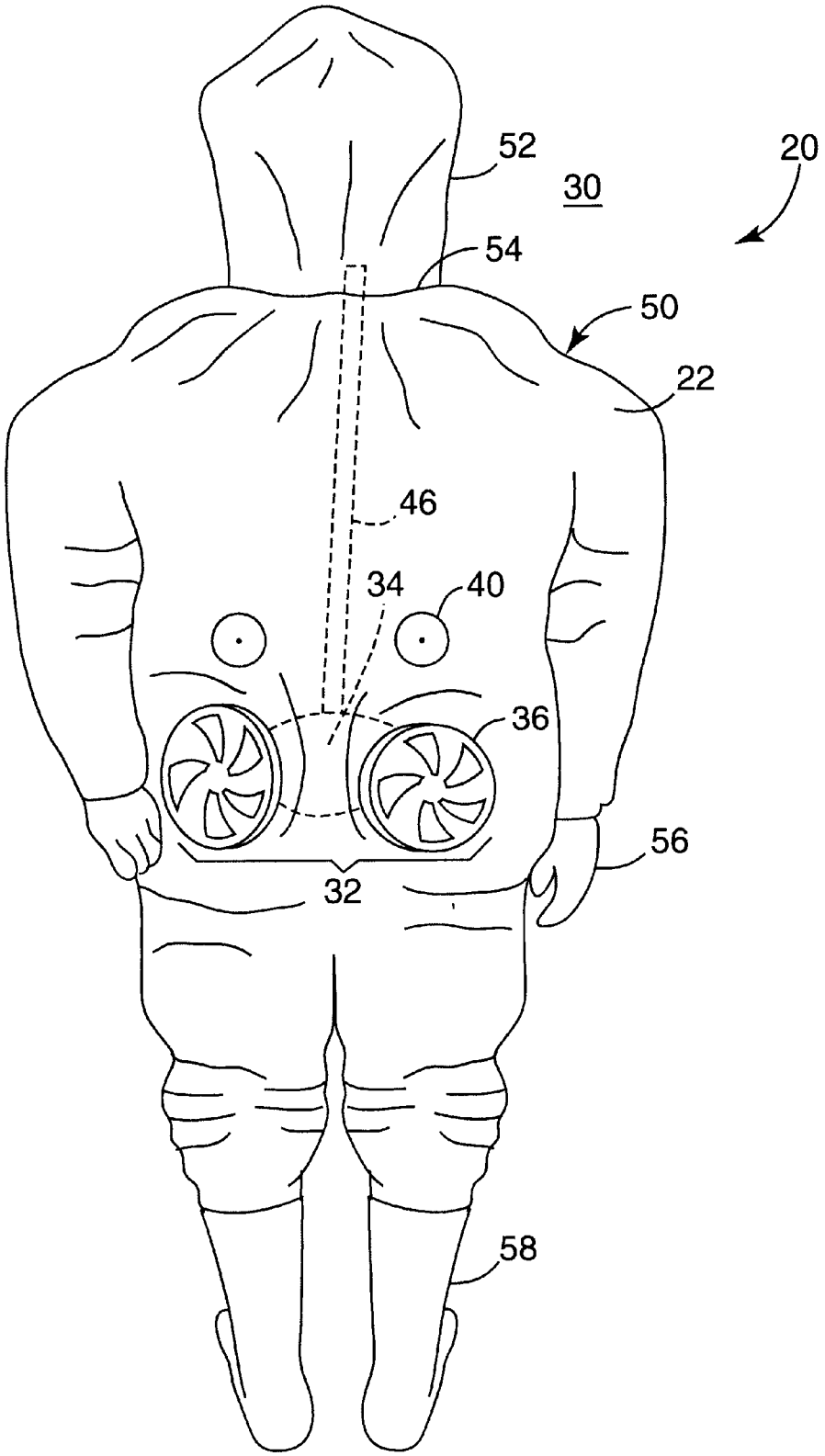
FIG. 7 shows a rear view of a chemical suit employing a personal containment system of FIG. 1.

FIG. 7 shows a rear view of a user within a personal containment device 20 in the form of a chemical suit 50. Device 20 includes an integrally formed hood 52. Hood 52 is drawn at the neck with a porous elastic neck band 54. Neck band 54 provides a partial flow restriction between hood 52 and the remainder of suit 50, providing improved air management and better control of localized carbon dioxide levels as is more fully described in copending application Ser. No. entitled PERSONAL PROTECTIVE SUIT WITH PARTIAL FLOW RESTRICTION, filed even date herewith, the entire disclosure of which is incorporated herein by reference. The leg and arm cuffs of chemical suit 50 also typically include elastic bands (not shown in FIG. 7). Personal containment device 20 is sealed from outer environment 30 by attachments such as gloves 56 and boots 58. Suit 50 includes air delivery system 32 whose blower 34 (shown in phantom) and filters 36 are located near the lower back of the user. Air delivery system 32 can be secured in place in a number of ways. For example, blower 34 can be placed in a pouch or pocket within suit 50, can be worn on a belt around the waist of a user, or the like. Vents 40 are included in suit 50 above filters 36. A conduit 46 (shown in phantom) is attached to blower 34 and extends up the back of suit 50, through elastic neck band 54 and into hood 52. Air from outer environment 30 is drawn into the filters 36 interfacing with outer environment 30 and filtered air is delivered to inner environment 28 via blower 34. Air is expelled into outer environment 30 through vents 40 once the pressure within suit 50 has exceeded a threshold.

Chemical suit 50 can be constructed from readily available materials and parts. Representative suits include those available from Respirex of Redhill Surrey, England and from Kappler, Inc. of Guntersville, Ala. Representative barrier materials include a high performance chemical barrier available from E. I DuPont de Nemours and Co. of Wilmington, Del. and sold under the trade designation TYCHEM™ TK, a high performance chemical barrier available from Kappler, Inc. and sold under the trade designation ZYTRON™ and a medium to low chemical barrier available from DuPont and sold under the trade designation TYVEK™ F. Other barriers are contemplated and may be selected based on the intended application. The suit may also include a combination of barriers such as a body portion constructed from a heavier high performance chemical barrier and a hood portion constructed from a lighter medium to low performance chemical barrier. The barrier is typically over 90 percent fluid tight, depending on the application. In one embodiment, the barrier is suitable for liquid applications, which typically means a mist or jet of liquid can be incident on the barrier and the barrier will be impervious to the liquid. For example, a barrier that is impervious to liquid may be only 95 percent gas tight. In another embodiment, the barrier may be constructed from a material that is impervious to gas. Often, any seams in the material are taped or welded to also be fluid tight. Accordingly, the barrier is generally impervious to the contaminant of a particular application, and does not necessarily hermetically seal inner environment 28 from outer environment 30.

Blower 34 is isolated within suit 50, thus simplifying construction of the blower. Blower 34 typically will not require decontamination after use, thus reducing maintenance costs. Isolating the blower can also prolong the blower's life, simplify cleaning, and permit the user to enter a decontamination shower or undergo other decontamination treatments without harm to the blower. Blower 34 can be driven by an internal or external power source such as a battery or pneumatic fluid supply. If the power source is located externally, barrier 22 may need to be fitted with suitably fluid-tight pass-throughs to provide power efficiently to the blower. A suitable blower 34 is available from 3M Company and is sold in the United Kingdom under the trade designation JUPITER™. This blower runs on an internal battery (not shown in FIG. 7) such as a four hour battery, an eight hour battery, an intrinsically safe battery, or a lithium battery. A lithium battery is particularly suited for applications where the suit may sit on a shelf for several years before it is needed. The lithium battery is currently not rechargeable, whereas the first three batteries are rechargeable. Another suitable blower is available from Safety Equipment Australia and sold under the trade designation SE400AT™.

Suitable filters 36 can be chosen based on the particular application, contaminant and chosen blower. One suitable filter is available from 3M Company and sold as a class ABEK P3 filter for use with the above-mentioned JUPITER blower. Another suitable filter is available from Safety Equipment Australia and sold as a class ABEK3P4 filter for use with the above-mentioned SE400AT blower. The filter may also be one suitable for use in outer environments in which the contaminants include chemical or biological weapons.

Figure 8:
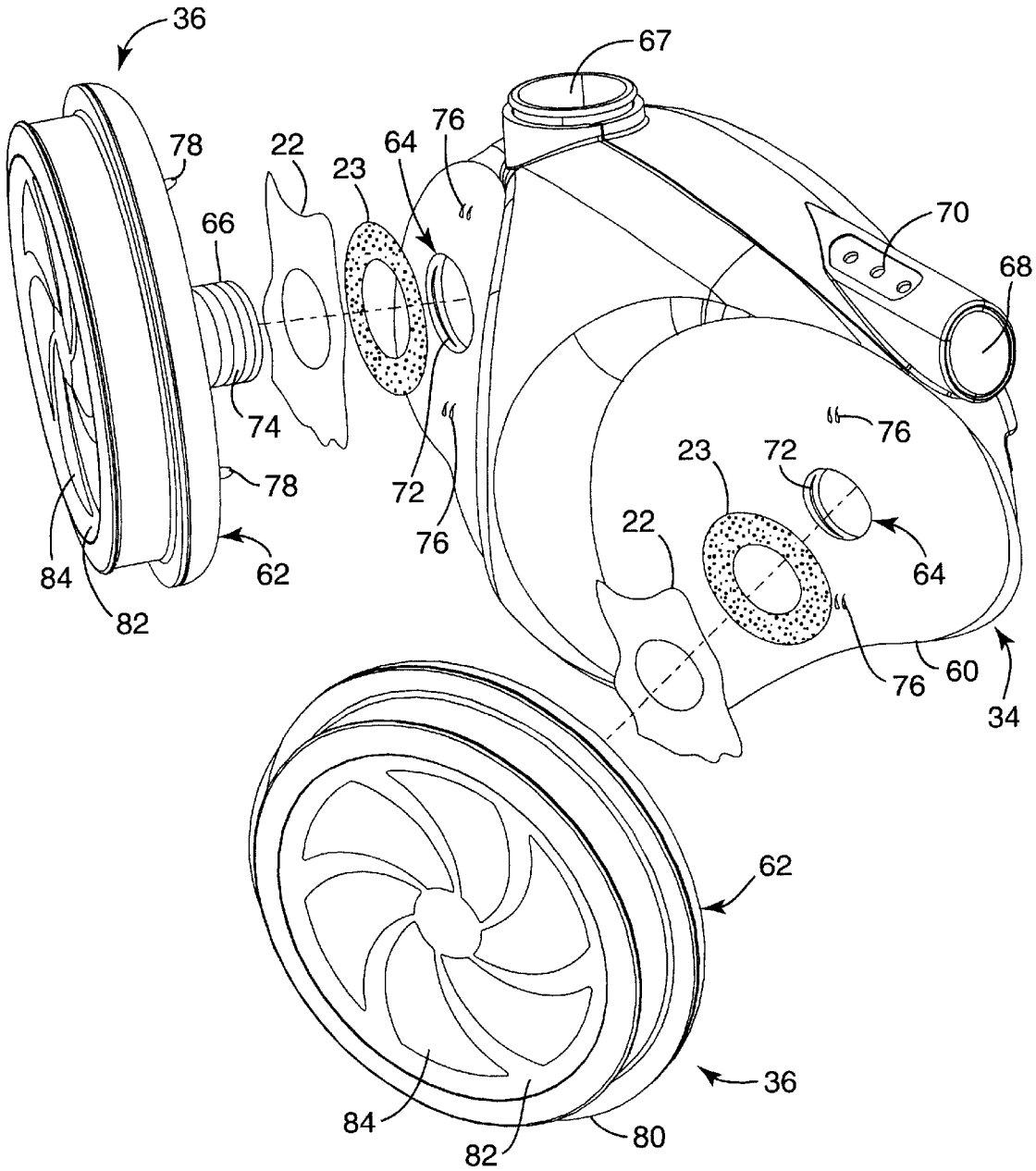
FIG. 8 shows an exploded perspective view of a portion of the personal containment system of FIG. 7.

FIG. 8 shows an exploded perspective view of air delivery system 32 in FIG. 7 including a blower 34 and filters 36. Specifically in the example, air delivery system 32 includes a blower housing 60, one or more replaceable filter cartridges 62, housing fluid inlets 64, filter fluid outlet 66, and housing fluid outlet 67. A perforated piece of doublesided closed cell foam adhesive tape 23 provides a generally fluid-tight and fixed connection between suit 50 and blower housing 60. During filter replacement, tape 23 makes it less likely that contaminants will enter suit 50 or that fluid inlet 64 will disappear within suit 50, thereby reducing hazard exposure and speeding up the filter replacement procedure.

A motor is provided within housing 60 to draw fluid from housing fluid inlets 64 and pass it under pressure through housing fluid outlet 67. Housing fluid outlet 67 mates with conduit 46 in FIG. 7 to provide fluid to the inner environment of suit 50. Housing fluid outlet 67 may be provided with a swivel to reduce strain on conduit 46. Housing 60 also includes a power switch 68 and an indicator 70 providing a variety of alerts such as whether air flow has dropped below a certain threshold. As described in published PCT Application No. WO 02/11815, the entire disclosure of which is incorporated herein by reference, airflow through blower 34 can be interrupted or reversed during filter replacement to permit hot change-out of filters 36 in a hazardous environment.

Each filter cartridge 62 includes a filter housing 80 having a major surface 82. Filter media 84 is retained within an internal chamber defined by filter housing 80. Openings in major surface 82 permit fluid to be drawn into filter media 84 and then pass through filter media 84 and out filter fluid outlet 66. Filter cartridge 62 is sealably mounted to blower housing 60 at filter fluid outlet 66 and housing fluid inlet 64.

Housing fluid inlets 64 have female threads 72 which are adapted to mate with male threads 74 on filter fluid outlet 66. Each of the threads 72 is highly pitched and extends only about once around the inner circumference of fluid inlet 64. Housing detents 76 are spaced radially around fluid inlet 64 and align with filter detents 78 on filter cartridges 62 when filter cartridge 62 and housing 60 are engaged. Housing detents 76 engage and releasably lock filter detents 78 when filter cartridge 62 is sealably mounted on housing 60. Housing 60 can also include a deformable inlet gasket (not shown in FIG. 8) located within housing inlet 64.

Figure 9:
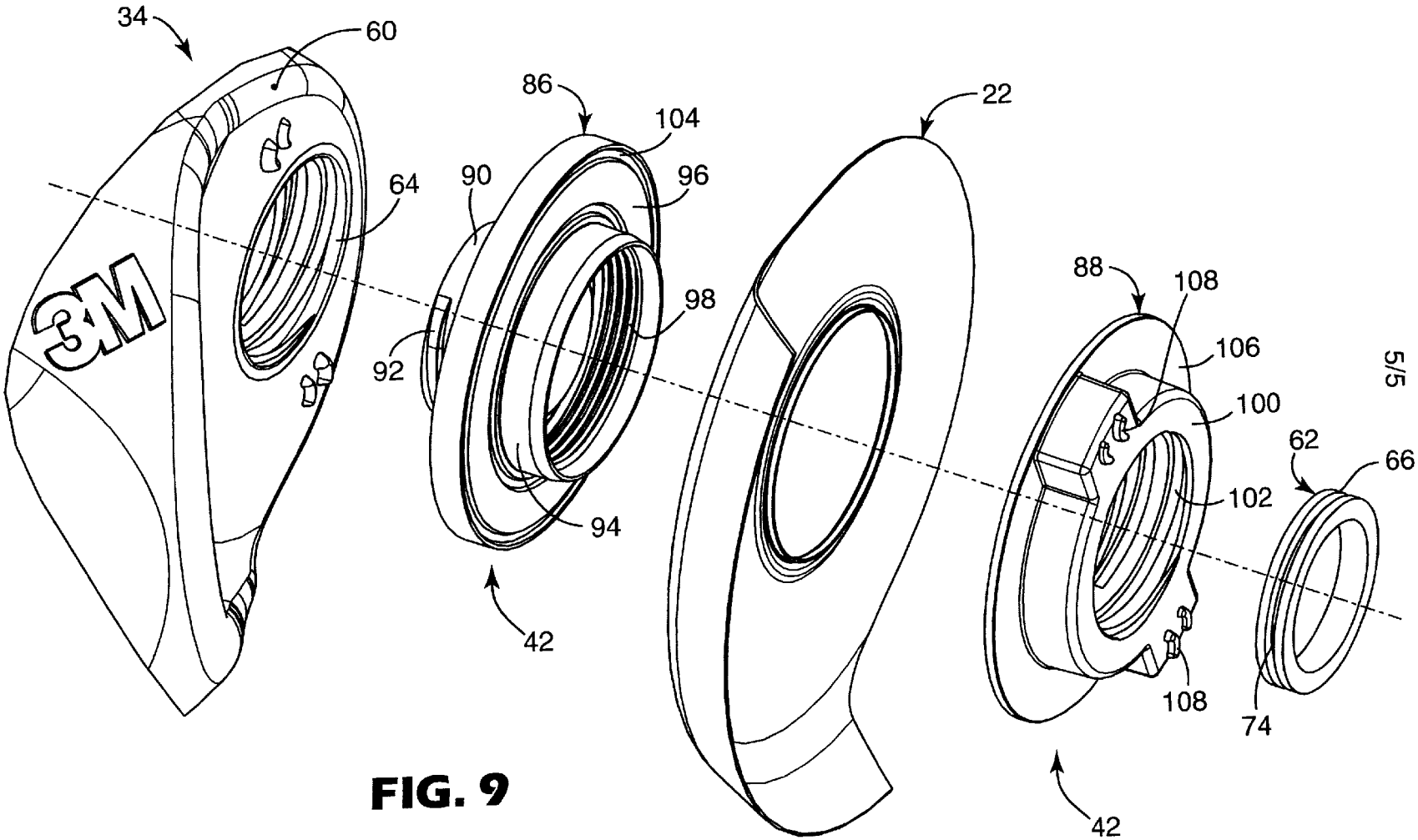
FIG. 9 shows an exploded perspective view of a portion of the personal containment system indicated in FIG. 4.

FIG. 9 shows an example of a mounting interface 42 introduced in FIG. 4. The interface 42 of the example includes two parts, an inner adapter 86 and an outer adapter 88. Interface 42 provides a mechanical seal around a hole in barrier 22 for air-delivery system 32, a fixed connection between blower 34 and barrier 22, and a mounting point for blower 34 and filter 36. Interface 42 preferably provides a generally fluid-tight seal to barrier 22 without requiring an adhesive or similar auxiliary sealing measure. Inner adapter 86 includes a protruding member 90 that is sized to mate with housing fluid inlet 64. Protruding member 90 includes a male thread 92 that, in one example, extends about twice around protruding member 90. Inner adapter 86 also includes a tongue 94 that extends axially from a flange 96. Tongue 94 includes a female thread 98 that extends around the inner circumference of tongue 94. Tongue 94 mates with an annular channel (not shown in FIG. 9) on outer adapter 88. The annular channel includes a male thread adapted to mate with female thread 98 of tongue 94. The annular channel is disposed within boss 100 protruding from outer adapter 88. A thread 102 extends around the inner circumference of boss 100, and is designed to mate with male threads 74 on filter fluid outlet 66 of filter cartridge 62. Flange 96 of inner adaptor 86 includes an annular groove 104 that is designed to mate with a tongue (not shown in FIG. 9) on flange 106 of outer adapter 88. Adaptors 86, 88 mate together to create a fluid-tight seal with barrier 22, which serves as a gasket between adaptors 86, 88. A plurality of adapter detents 108 are disposed on boss 100 to mate with detents on filter cartridge 62 and releasably lock filter cartridge to interface 42. Separate additional gaskets may also be used to seal the filter cartridge, interface and blower housing. In the example, interface 42 is formed of a thermoplastic that is chemically inert and mechanically strong enough to hold a thread. One suitable material is a glass filled polypropylene. The amount of glass filler may be 10 percent to 30 percent by weight.

The invention is especially suited for use in situations where a contaminated or otherwise hazardous environment is known to include oxygen, but whose hazards are otherwise generally unknown. The invention can be used in environments where electric sparks or the like can provide a hazard. Accordingly, the invention is suitable for use in more environments than typical PAPR containment systems. Still further, the personal containment system of the invention can be much less expensive to manufacture or maintain than typical SCBA containment systems.

Although the personal containment system and its components have been described with reference to examples, or embodiments, it is to be understood that changes may be made in form and detail without departing from the spirit and scope of the invention.

We claim:

1. A personal containment system comprising:

a generally fluid-tight barrier having an inner surface defining an inner environment that can surround a user of the containment system and an outer surface defining an outer environment that can contain one or more hazards;

an air delivery system that can provide filtered air from the outer environment to the inner environment, comprising a replaceable filter exposed to the outer environment and a blower generally isolated from the outer environment and in fluid communication with the filter; and a port for delivery of filtered air through the barrier to the blower, the port providing a generally fluid tight connection to the barrier and blower during filter replacement.

2. The personal containment system of claim 1 wherein the port is sealably attached to the blower.

3. The personal containment system of claim 1 wherein the port is affixed to the blower.

4. The personal containment system of claim 1 wherein the port is adhesively attached to the blower.

5. The personal containment system of claim 1 wherein the blower has a fluid inlet and the port is sufficiently fixed in position with respect to the blower so that the inlet remains accessible during removal and replacement of the filter despite movement or other disturbance of the system while the filter is disconnected.

6. The personal containment system of claim 1 wherein the port comprises a mounting interface to which the blower can be attached.

7. The personal containment system of claim 1 wherein the port comprises a mounting interface to which the filter can be attached.

8. The personal containment system of claim 1 wherein the port comprises a mounting interface to which the blower and filter can be attached.

9. The personal containment system of claim 1 wherein the barrier includes a vent adapted to allow passage of gases from the inner environment to the outer environment and to prevent passage of fluid from the outer environment to the inner environment.

10. The personal containment system of claim 1 wherein the blower includes a battery.

11. The personal containment system of claim 1 wherein the blower is substantially disposed in the inner environment.

12. The personal containment system of claim 1 wherein the filter is substantially disposed in the outer environment.

13. The personal containment system of claim 1 wherein normal airflow through the blower can be interrupted during filter replacement.

14. The personal containment system of claim 1 in the form of a protective suit.

15. The personal containment system of claim 1 in the form of a protective tent.

* * * * *

UNITED STATES PATENT AND TRADEMARK OFFICE

CERTIFICATE OF CORRECTION

PATENT NO. : 6,796,304 B2
DATED : September 28, 2004
INVENTOR(S) : Odell, Raymond It is certified that error appears in the above-identified patent and that said Letters Patent is hereby corrected as shown below:

Column 1,
Line 7, after "of" insert -- pending --.
Line 10, delete "now abandoned,".

Column 4,
Line 4, delete "Ser. No." and insert -- (Attorneys Docket No. 57745US004) -- therefore Signed and Sealed this Eighteenth Day of January, 2005

JON W. DUDAS
*Director of the United States Patent and Trademark Office*